United States Patent [19]

Brühwiler

[11] Patent Number: 5,039,982

[45] Date of Patent: Aug. 13, 1991

[54] SAFEGUARDING AGAINST BURGLARY

[75] Inventor: Othmar Brühwiler, Gossau, Switzerland

[73] Assignee: Patago AG, Dubendorf, Switzerland

[21] Appl. No.: 524,805

[22] Filed: May 18, 1990

[30] Foreign Application Priority Data

May 30, 1989 [CH] Switzerland ..... 2030/89

[51] Int. Cl.[5] ..... G08B 13/14; E05B 69/00; A45C 13/10; B65D 85/672

[52] U.S. Cl. ..... 340/572; 70/58; 206/1.5; 206/387

[58] Field of Search ..... 340/572, 568; 70/58; 206/387, 1.5

[56] References Cited

U.S. PATENT DOCUMENTS 3,933,240 1/1976 Humble ..... 206/387 X 4,716,745 1/1988 Henh ..... 70/58

*Primary Examiner*—Glen R. Swann, III

*Assistant Examiner*—Thomas J. Mullen, Jr.

*Attorney, Agent, or Firm*—Laurence R. Brown

[57] ABSTRACT

The casing serving as a safeguard against burglary for tape recording cassette containers is made of a plastic material and includes in the narrow wall opposite of the insertion opening a perforation of the wall close to an edge and extending at its center substantially at the level of the angularly adjacent inner surface of the casing into the casing. Two locking bodies arranged adjacent of each other and integrally connected by a base disk and having a hook-like broadened and thereafter wedge-like sharpened end section are inserted into the perforation. The hinged lid of the tape recorder cassette container is kept somewhat depressed by the hook-like broadened end section which end section simultaneously engages over the adjacent side wall of the contained wherewith the container of the cassette and the casing are interlocked. In order to unlock the connection the interconnection between the locking bodies and the base disk resting against the outside of the casing is ruptured by means of a special tool.

4 Claims, 2 Drawing Sheets

SAFEGUARDING AGAINST BURGLARY

BACKGROUND OF THE INVENTION

1. Field of the Invention

The present invention relates to an apparatus for safeguarding against theft of a cassette container to be sold, specifically a container for a recording tape, which apparatus includes a casing in which the container for a recording tape is to be received which casing has an opening for insertion of the recording tape container and means for emitting a signal for triggering an alarm, and includes further locking members intended to engage the cassette container and which are unlockable for separating the cassette container from the casing only by means of a special tool.

2. Description of the Prior Art

Known containers of this kind and made of a plastic material serve as apparatus for safeguarding against burglary for instance for receipt of a container for a compact disk and include for instance a magnetic tape such to trigger an alarm when passing an induction loop located at the exit of a store if the container is taken along including the merchandise without paying for the same. The separating of the casing from the container to be purchased is done at the cash register by aid of a special tool. In known casings for compact disk containers at least one bolt, pin or hook which is movably arranged at the container engages into a corresponding recess at the edge of the narrow side wall of the container and is subjected at a variety of designs generally to a spring action and can be operated into the unlocking position only by means of a special tool for which purpose also magnetic force is made use of.

Due to their specific design containers for compact disks have at the narrow side have in the wall which may be used for a latch to a casing, but this principle can not be made use of if the container to be sold does not include such recesses in the wall.

SUMMARY OF THE INVENTION

It is, therefore, a general object of the invention to provide an apparatus for safeguarding against burglary by utilization of a casing for tape recording cassette container having means for triggering an alarm but have no recesses in the walls suitable for an engagement by locking elements.

A further object of the present invention is to provide such a safeguarding apparatus in which the casing which is made of a rigid material and is intended to receive a cassette container having a hinged cover includes at a narrow side of the casing opposite the insertion opening a perforation in the wall located off-center of same, which perforation extends by its center substantially to the level of the angularly adjoining casing inner surface into the casing, and includes at least one locking body which is insertable from the outside of the casing through said wall perforation and placeable at the casing by an abutment which locking body includes a hook-like broadened and thereafter wedge-like sharpened end section in order to keep the hinged cover of the cassette container inserted in the casing pressed somewhat inwards by means of the wedge-like end section of the locking body whereby it simultaneously engages as hook over the adjacent side-wall of the cassette container for locking the cassette container to the casing.

Yet a further object is to provide an apparatus for safeguarding against burglary in which for achieving a secure locking of casing and cassette container two locking bodies are used which are arranged at a distance from and adjacent each other which bodies are integrally interconnected by a base disk acting as abutment and for an arresting stop at the casing and which is located in a recess in the casing corresponding to the base disk, and in which the locking bodies are integrally connected to the base disk and the interconnecting zones between the base disk and locking bodies are structured as weakened zones such that they rupture at this location upon a pressure action from the outside, such that the locking bodies and accordingly the cassette container can be separated from the casing whereby rupturing occurs when pins of a special tool penetrating through the flat planar base disk.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF PREFERRED EMBODIMENT

Figure 1:
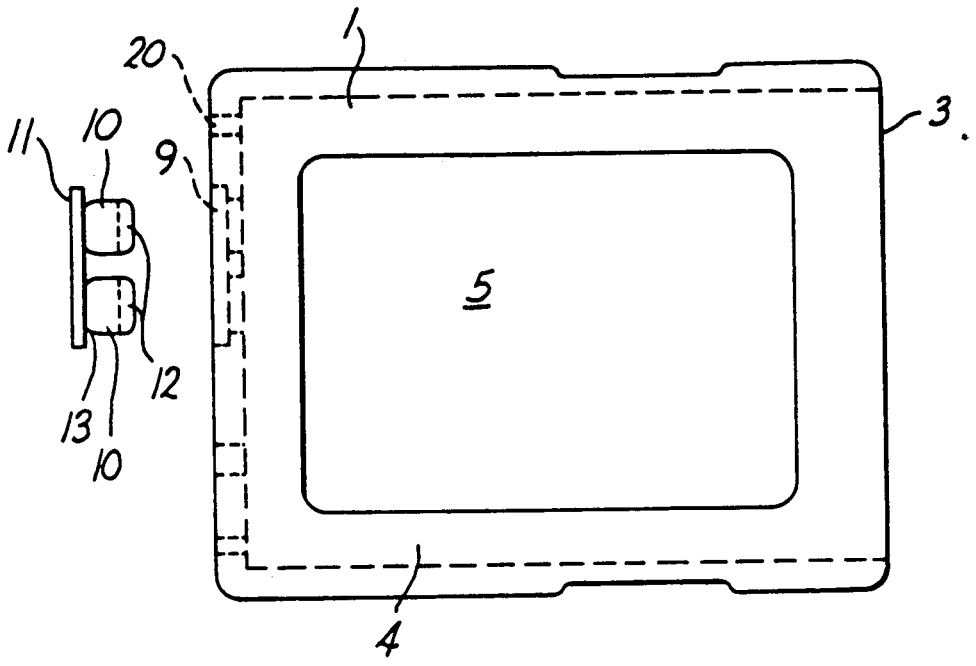
FIG. 1 is a front view of a casing and a view of two separately illustrated locking bodies to be inserted into the casing.
Figure 2:
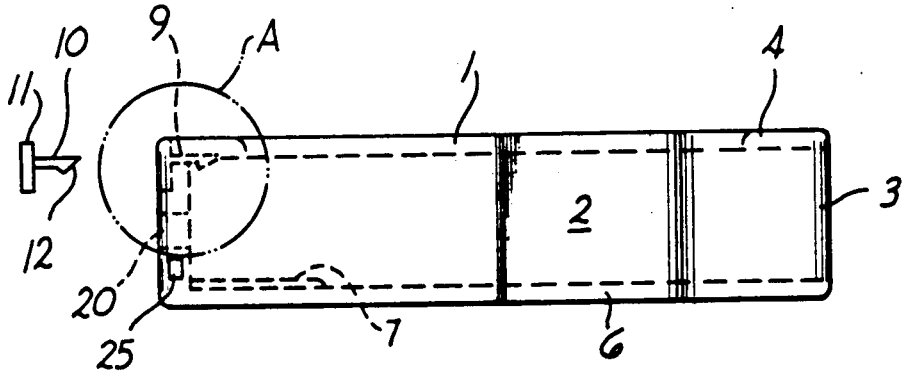
FIG. 2 is a side view of the casing and illustrating the separately designed locking bodies.

The casing 1 according to FIGS. 1 and 2 is made of a transparent plastic material and having a square hollow space 2 for the insertion of a tape recorder cassette container through an insertion opening 3 at a narrow side which container is not illustrated in FIGS. 1 and 2. Due to the large cut-out 5 of the wall the face surface 4 the casing has the shape of a frame and the closed bottom surface 6 located oppositely the cut-outs includes at its inner side at the end area opposite the insertion opening 3 an inclined section 7 for contacting the not illustrated tape recorder cassette container and operative to eliminate the freedom of movement of the cassette container needed when inserting same upon reaching the inserted end position such that the cassette container is urged against the face surface 5 of the casing 1. The casing includes at its inner side the commonly known elements 25 which may trigger in cooperation with an induction loop an alarm, such as for instance magnetic strips, diodes or similar structures.

Figure 3:
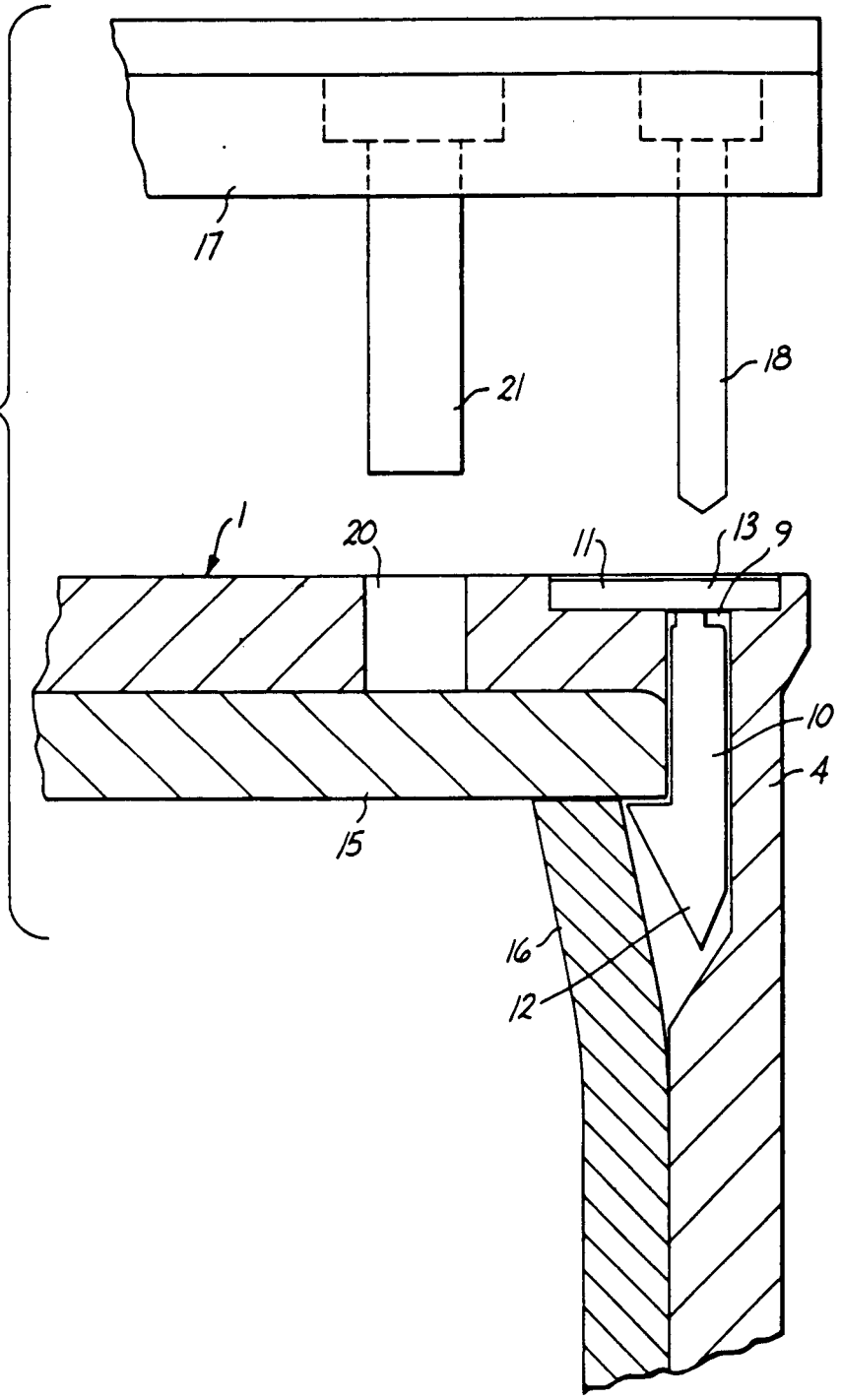
FIG. 3 illustrates the detail A of FIG. 2 on a larger scale, shown in section through the casing including a cassette container inserted therein.

According to FIGS. 1 and 2 the casing 1 has at the upper narrow side a perforation 9 of the wall located off-center of this narrow side which perforation has an elongate shape and extends at its center substantially to the level of the angularly adjoining inner surface of the casing of the face surface 4 such as illustrated in FIG. 3. In FIG. 1 two locking bodies 10 are illustrated adjacent the casing 1 which locking bodies 10 are located at a distance from each other and are integral with a base disk 11. In the side view according to FIG. 2 the locking bodies 10 include a hook-like widened and thereafter sharpened end section 12. The interconnecting zone between the base disk 11 and the locking bodies 10 integrally connected thereto is structured as weakened zone 13, i.e. a smaller cross-sectional material area is present at that zone.

The container of the tape recorder cassette which for safeguarding against burglary is fixedly to be mounted to the casing 1 whereby the connection can be unlocked by means of a special tool only includes a hinged cover or lid hingedly mounted to a lower part of the container which cover when the container is closed can be pressed somewhat into the lower part of the container. This property of the cassette container is now used for the connection to the casing 1.

In the detailed view on an enlarged scale according to FIG. 3 a part of a sidewall 15 of a container for a tape recorder cassette and a part of the cover 16 of the container are illustrated. In order to connect the container of the tape recorder cassette to the casing 1 the two locking bodies 10 which are integrally mounted to the base disk 11 are inserted firstly into the wall perforation 9 in the casing 1 and thereafter the casing 1 is rested upright against a table-top whereby the base plate is at the bottom, and thereafter the cassette container is inserted through the insertion opening 3 into the casing 1. The casing 1 consists of a special plastic material which has such a property that the area of the frame shaped face surface of the casing 1 located in FIG. 3 at the right side adjacent the locking body 10 and having a wall thickness of only 0,8 mm can yield somewhat. The sidewall 15 of the container of the cassette moves over the hook-like broadened and thereafter wedge-like sharpened end section 12 of the locking body 10 and this end section 12 holds then the cover 16 of the cassette container somewhat depressed whereby the end section engages simultaneously as a hook behind the sidewall 15. Because the base disk 11 of the locking bodies 10 rests against the casing 1 the container of the tape recording cassette can not be pulled out of the casing 1 in the locked state thereof.

In order to separate the tape recording cassette container from the casing 1 the interconnection between the locking bodies 10 and the base disk 11 which is formed as weakened zone 13 must be ruptured. To this end a special tool 17 illustrated in part in FIG. 3 above the casing 1 is used. This tool comprises in the view of the drawing at the right side two sharpened bolts 18 located behind each other of which each one presses in the center of a locking body 10 against the base disk and penetrates through this in fact extremely thin disk in order to rupture the connection between the disk and the locking body at the weakened zone 13 when the tool and the casing are pressed against each other. The casing 1 includes further at the narrow side where the locking bodies 10 are located at least one through bore 20 located preferably on the longitudinal center line of this narrow side of the casing such as illustrated in FIG. 2. The tool 17 includes further an ejector pin 21 which when operating the tool is pressed through this bore 20 against the sidewall 15 of the cassette container to push thereby the cassette container from the casing. It is also possible to arrange a plurality of such bores at the casing and accordingly a plurality of ejector pins on the tool.

By means of the locking bodies consisting also of a plastic material and forming cheap throw away elements an economical burglary safeguarding apparatus is provided which features additionally the advantage that it can be used in the existing and widespread shelves of shops because the casing 1 is shorter than the tape recorder cassette container inserted in an upright state and of which the lower edge is freely exposed for inserting of such into the shelf.

While there is shown and described a present preferred embodiment of the invention it is to be distinctly understood that the invention is not limited thereto but may be otherwise variously embodied and practiced within the scope of the following claims.

I claim:

1. An apparatus for safeguarding against theft of a cassette container for a recording comprising in combination, a casing in which said cassette container is to be received which casing has an opening for receiving the recording means in said casing for emitting a signal for triggering an alarm, locking members held by said casing intended to engage a cassette container inserted into the casing and which locking members have unlocking structure for separating the cassette container from the casing only by means of a special took, said casing being made of a rigid material with an opening intended to receive a cassette container having a hinged cover in a position facing a cassette container end wall, a perforation in the end wall for receiving said locking members off-center substantially adjacent a casing inner sidewall surface said locking members comprising an unit which is insertable from the outside of the casing through said perforation with locking body hook-like means positioned to engage and move inwardly said hinged cover a cassette container inserted in said casing and whereby the hook-like mean simultaneously engages as a locking hook over an adjacent sidewall of the cassette container to lock the cassette container within the casing.

2. The apparatus of claim 1, in which said two locking members are arranged on said unit at a distance from and alongside each other and integrally extend from a base disk by weakened structure interconnecting said base disk and said locking members which is rupturable from the outside of said cassette container by a special tool for unlocking the locking members from the base disks to rupture said weakened structure.

3. The apparatus of claim 1, in which the casing has structure for positioning the cassette container cover and adjacent sidewall closely to substantially eliminate clearance between the sidewall of the cassette container and the hook-like means engaging the sidewall.

4. The apparatus of claim 2, in which the casing end wall comprises at a location separate from the perforation in the end wall a through bore for receiving an ejector pin of said special tool through the casing to push against the sidewall of the cassette container with guiding means on said special tool for rupturing of the weakened structure between the locking members and the base disk.

* * * * *